166-273 SR
4/30/85 OR 4,513,821

United States Patent [19]
Shu

[11] Patent Number: 4,513,821
[45] Date of Patent: Apr. 30, 1985

[54] LOWERING $CO_2$ MMP AND RECOVERING OIL USING CARBON DIOXIDE

[75] Inventor: Winston R. Shu, Dallas, Tex.

[73] Assignee: Mobil Oil Corporation, New York, N.Y.

[21] Appl. No.: 576,696

[22] Filed: Feb. 3, 1984

[51] Int. Cl.[3] ..... E21B 43/16; E21B 43/20
[52] U.S. Cl. ..... 166/273; 166/302
[58] Field of Search ..... 166/273, 274, 302, 303

[56] References Cited

U.S. PATENT DOCUMENTS

| | | | |
|---|---|---|---|
| 3,586,107 | 6/1971 | Parrish | 166/273 |
| 3,811,502 | 5/1974 | Burnett | 166/273 |
| 4,224,992 | 9/1980 | Comberiarti et al. | 166/274 |
| 4,249,607 | 2/1981 | Allen | 166/274 |
| 4,250,965 | 2/1981 | Wiseman, Jr. | 166/302 |

OTHER PUBLICATIONS

Yellig, W. F., Metcalfe, R. S., "Determination and Prediction of $CO_2$ MMP", *J. Pet. Tech.*, (1980), vol. 32, pp. 160–168.
Stalkup, F. I., "$CO_2$ Miscible Flooding: Past, Present and Outlook for the Future", *J. Pet. Tech.*, (Aug. 1978), pp. 1102–1112.
Miscible Displacement, by Fred I. Stalkup, Jr., Society of Petroleum Engineers, 1983.
Effects of Impurities on Minimum Miscibility Pressures and Minimum Enrichment Levels for $CO_2$ and Rich-Gas Displacements, by R. S. Metcalfe, SPE, Amoco Production Co.

*Primary Examiner*—Stephen J. Novosad
*Assistant Examiner*—Bruce M. Kisliuk
*Attorney, Agent, or Firm*—Alexander J. McKillop; Michael G. Gilman; Lawrence O. Miller

[57] ABSTRACT

Oil is recovered by a $CO_2$ miscible oil recovery method in which the $CO_2$ minimum miscibility pressure of the oil-containing formation is lowered by injecting a coolant into the formation. The formation is then pressurized to a pressure at least that of the reduced $CO_2$ minimum miscibility pressure by injecting a fluid therein. A slug of carbon dioxide is then injected into the formation at the formation pressure whereby the carbon dioxide is miscible with the formation oil and thereafter a driving agent is injected to displace the formation oil and carbon dioxide toward a production well from which oil is produced.

10 Claims, 1 Drawing Figure

REDUCTION IN $CO_2$ MMP
BY ADIABATIC COOLING
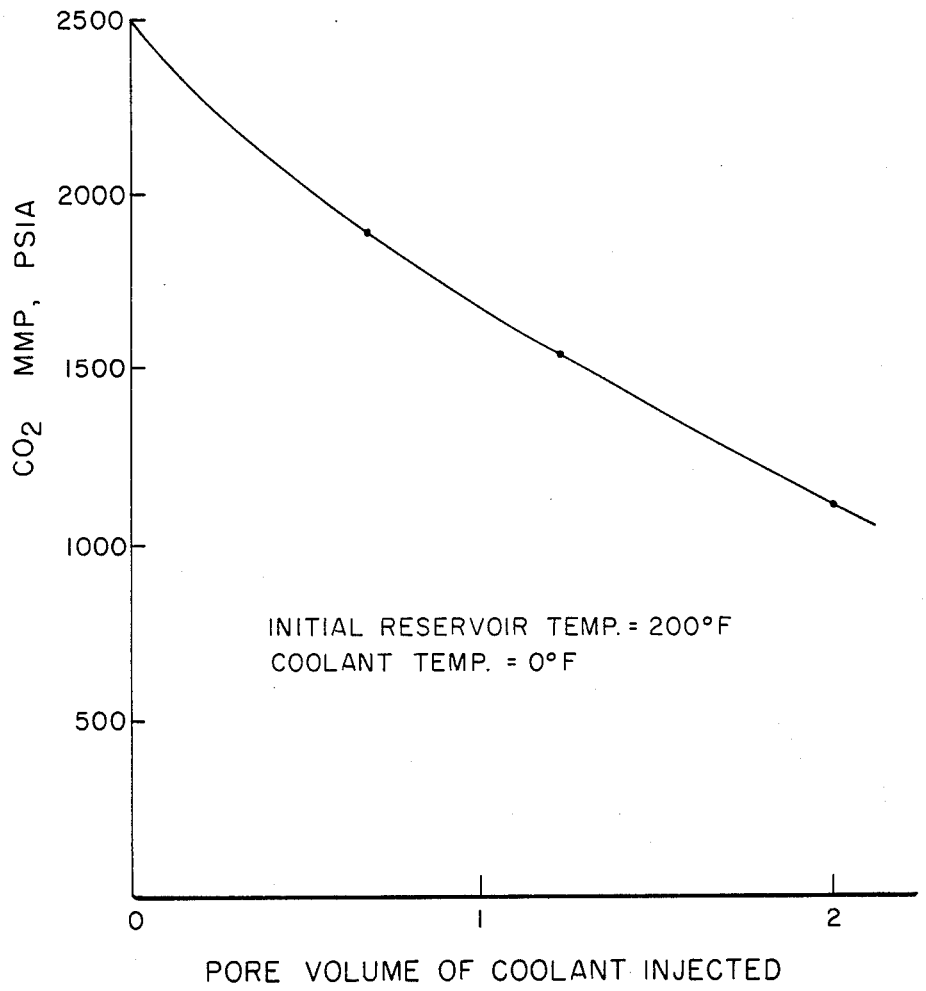

LOWERING $CO_2$ MMP AND RECOVERING OIL USING CARBON DIOXIDE

FIELD OF THE INVENTION AND BACKGROUND OF THE INVENTION

Field of the Invention

This invention relates to a method for the recovery of oil from a subterranean, viscous oil-containing formation by cooling the formation to reduce the carbon dioxide minimum miscibility pressure (MMP), injecting a slug of carbon dioxide into the formation at the reduced $CO_2$ MMP at which carbon dioxide is miscible with the formation oil, and thereafter injecting a driving agent to move the slug of carbon dioxide and the formation oil through the formation to a production well.

BACKGROUND OF THE INVENTION

When a well is completed in a subterranean reservoir, the oil present in the reservoir is normally removed through the well by primary recovery methods. These methods include utilizing native reservoir energy in the form of water or gas existing under sufficient pressure to drive the oil from the reservoir through the well to the earth's surface. This native reservoir energy most often is depleted long before all of the oil present in the reservoir has been removed from it. Additional oil removal has been effected by secondary recovery methods of adding energy from outside sources to the reservoir either before or subsequent to the depletion of the native reservoir energy.

Miscible phase displacement techniques comprise a form of enhanced recovery in which there is introduced into the reservoir through an injection well a fluid or fluids which are miscible with the reservoir oil and serve to displace the oil from the pores of the reservoir and drive it to a production well. The miscible fluid is introduced into the injection well at a sufficiently high pressure that the body of fluid may be driven through the reservoir where it collects and drives the reservoir oil to the production well.

The process of miscible flooding is extremely effective in stripping and displacing the reservoir oil from the reservoir through which the solvent flows. This effectiveness is derived from the fact that a two-phase system within the reservoir and between the solvent and the reservoir is eliminated at the conditions of temperature and pressure of the reservoir, thereby eliminating the retentive forces of capillarity and interfacial tension which are significant factors in reducing the recovery efficiency of oil in conventional flooding operations where the displacing agent and the reservoir oil exist as two phases in the reservoir.

More recently, carbon dioxide has been used successfully as a miscible oil recovery agent. Carbon dioxide is a particularly desirable material because it is highly soluble in oil, and dissolution of carbon dioxide in oil causes a reduction in the viscosity of the oil and increases the volume of oil, all of which improve the recovery efficiency of the process. Carbon dioxide is sometimes employed under non-miscible conditions, and in certain reservoirs it is possible to achieve a condition of miscibility at reservoir temperature and pressure between essentially pure carbon dioxide and the oil.

The use of carbon dioxide as a recovery agent by means of a conditional miscible flooding process, where the carbon dioxide miscibly displaces the reservoir oil is described in U.S. Pat. No. 3,811,502 to Burnett.

The pressure level at which carbon dioxide is miscible with most reservoir oils is at a pressure level greater than a certain minimum, see Stalkup, F. I., "Carbon Dioxide Miscible Flooding: Past, Present, and Outlook for the Future", *J. Pet. Tech.*, (August 1978) pp. 1102–1112. This minimum pressure is defined as the carbon dioxide minimum miscibility pressure (MMP).

The changes in $CO_2$ MMP are direct functions of temperature. In an article by Yellig et al, "Determination and Prediction of $CO_2$ Minimum Miscibility Pressures", *J. Pet. Tech.*, (1980), Vol. 32, pp. 160–168, it is shown that for every 50° F. drop in temperature, the $CO_2$ MMP decreases by about 600–700 psia.

The present invention provides a method for more efficiently utilizing carbon dioxide in a carbon dioxide miscible displacement oil recovery method wherein the $CO_2$ MMP of the formation is lowered thereby achieving miscibility at a lower pressure which not only saves energy by allowing $CO_2$ injection pressures to be lower but also is crucial to achieving miscibility in low pressure reservoirs. In these reservoirs, without lowering the MMP, it would not be possible to achieve miscibility with an enhanced increase in oil recovery.

SUMMARY OF THE INVENTION

The present invention relates to a method for the recovery of oil from a subterranean, viscous oil-containing formation penetrated by at least one injection well and at least one spaced-apart production well and having fluid communication therebetween, comprising the steps of (a) determining the minimum miscibility pressure at the temperature of said formation at which carbon dioxide will miscibly displace said formation oil, (b) injecting sufficient liquid or gaseous coolant into the formation via said injection well to lower the temperature of the formation between the injection well and production well to a temperature corresponding to a predetermined lower $CO_2$ minimum miscibility pressure, (c) injecting a fluid into said formation to pressurize said formation to a pressure at least equal to the predetermined lower $CO_2$ minimum miscibility of step (b) at which miscibility exists between said carbon dioxide and said oil, (d) injecting into said formation via said injection well a slug of carbon dioxide at said pressure of step (c) in an amount sufficient to establish a miscible transition zone of said slug with said formation oil, (e) injecting a drive fluid into said formation via said injection well to drive the carbon dioxide and oil through the formation towards said production well, and (f) recovering oil displaced by the carbon dioxide from the formation via the production well.

BRIEF DESCRIPTION OF THE DRAWING

The drawing illustrates the reduction of $CO_2$ minimum miscibility pressures of an oil reservoir as a function of the pore volume of coolant injected.

DESCRIPTION OF THE PREFERRED EMBODIMENT

In it broadest aspect the invention comprises first introducing a coolant into an oil-containing formation to lower the $CO_2$ minimum miscibility pressure (MMP) of the formation to a predetermined level, injecting a fluid into the formation to pressurize the formation to a pressure level at least that of the predetermined $CO_2$ minimum miscibility pressure at which pressure carbon dioxide is miscible with the formation oil, thereafter injecting a slug of carbon dioxide into the formation in an amount sufficient to form a miscible transition zone with formation oil and thereafter injecting a driving fluid such as a gas or water to displace the carbon dioxide and oil through the formation to a production well from which it is produced.

The process of my invention is best applied to a subterranean, oil-containing formation penetrated by at least one injection well and at least one spaced-apart production well. The injection well and production well are in fluid communication with the formation by means of perforations. The present invention is particularly useful in recovering oil from shallow formations that have low pressures at which the overburden above the formation would fracture or from reservoirs having low pressure due to fluid depletion that would require extensive fluid injection to repressure the reservoir. While recovery of the type contemplated by the present invention may be carried out by employing only two wells, it is to be understood that the invention is not limited to any particular number of wells. The invention may be practiced using a variety of well patterns as is well known in the art of oil recovery, such as an inverted five spot pattern in which an injection well is surrounded with four production wells, or in a line drive arrangement in which a series of aligned injection wells and a series of aligned production wells are utilized. Any number of wells which may be arranged according to any pattern may be applied in using the present method as illustrated in U.S. Pat. No. 3,927,716 to Burdyn et al, the disclosure of which is hereby incorporated by reference.

There is a minimum pressure at which miscibility can exist between carbon dioxide and formation oil at the temperature of the formation which is known as the carbon dioxide minimum miscibility pressure (MMP). This minimum pressure can be determined by means of experimental techniques such as the slim tube method described in the previously cited reference of Yellig et al, "Determination and Prediction of $CO_2$ Minimum Miscibility Pressures", *J. Pet. Tech.*, (1980), Vol. 32, pp. 160–168, the disclosure of which is hereby incorporated by reference.

While the minimum miscibility pressure is dependent upon the properties of the reservoir and the fluid compositions and the temperature, the pressure range is generally in the range of about 1000 psia to 4000 psia.

In accordance with the invention, the $CO_2$ minimum miscibility pressure of the formation oil at the formation temperature is determined by means of the slim tube method disclosed above. The $CO_2$ MMP is a direct function of temperature and with every 50° F. drop in temperature, the $CO_2$ MMP decreases by about 600–700 psia, see Yellig et al cited above.

According to the invention, to lower the $CO_2$ MMP of the formation, sufficient liquid or gaseous coolant is injected into the formation via the injection well to lower the temperature of the formation between the injection well and production well to the desired temperature thereby lowering the $CO_2$ MMP a predetermined amount. Suitable coolants include water at a temperature lower than the formation temperature, water mixed with anti-freeze at a temperature below the normal freeze temperature of the pressurized water, Freon, liquid nitrogen, and liquid carbon dioxide. The amount of coolant required to reduce the temperature and $CO_2$ MMP of the formation to the desired level may be determined by computing the heat capacity of the reservoir rock as defined by the following formula:

$$C_p=(1-\phi)C_{pr}+\phi(S_oC_{po}+S_wC_{pw})$$

wherein $C_p$ is the heat capacity of the bulk reservoir rock matrix expressed as Btu per cubic feet per °F., $\phi$ is porosity of the formation, $C_{pr}$ is heat capacity of dry rock, $S_o$ is oil saturation of the formation, $C_{po}$ is heat capacity of the oil, $S_w$ is water saturation of the formation, and $C_{pw}$ is heat capacity of water. Based on 30 percent porosity, reservoir rock heat capacity of 35 Btu per cubic foot per °F., oil saturation 0.4 pore volume, oil heat capacity of 31.2 Btu per cubic foot per °F., a water saturation of 0.5 pore volume, and a water heat capacity of 62.4 Btu per cubic foot per °F., the heat capacity of the reservoir rock is $$C_p=(1-0.3)\times 35+0.3(0.4\times 31.2+0.5\times 62.4)$$

or $$C_p=37.6 \text{ Btu per cubic feet per °F.}$$

Assuming that the formation temperature is originally 200° F. and that of the coolant is 0° F., and assuming further that the heat capacity of the coolant is the same as that of water and heat transfer to the over and understrata are negligible, the amount of coolant required to cool the formation by 50° F. is $$\frac{(200-150)\times 37.6\times 1}{62.4}=0.2 \text{ CF}=0.67 \text{ pore volume}$$

Reduction in $CO_2$ MMP as a function of pore volume of coolant injected is shown in the drawing.

After sufficient coolant has been injected into the formation to lower the $CO_2$ MMP to the predetermined level, the formation may be further pressurized to a pressure equal to the reduced $CO_2$ MMP if necessary. Pressurization of the formation is accomplished by injecting a pressurizing fluid into the formation via the injection well. Suitable fluids are carbon dioxide, water and other suitable fluids which do not increase the MMP.

Once the formation is flooded to a pressure corresponding to the reduced $CO_2$ MMP of the formation at which carbon dioxide is miscible with the formation oil at the temperature of the formation, a slug of carbon dioxide is injected into the formation via the injection well. The amount of carbon dioxide injected into the formation is an amount sufficient to establish a miscible transition zone of the carbon dioxide with the formation oil. Such a transition zone includes a portion next to the formation oil which is a carbon dioxide-formation oil mixture. The amount of carbon dioxide required may be determined by known procedures in laboratory-conducted floods under simulated reservoir conditions. The amount will vary depending upon reservoir conditions and the economics. Generally, the amount of carbon dioxide injected is in the range of 10 to 40 percent of hydrocarbon pore volume. The amount of $CO_2$ may be less if liquid $CO_2$ is used to lower the formation temperature.

After having established the miscible transition zone between the formation oil and the carbon dioxide, a driving fluid is then injected to displace the oil, the transition zone and the carbon dioxide through the formation towards the production well from which the oil can be produced. The driving fluid preferably is a gas such as air, nitrogen, combustion gas, flue gas, separator gas, natural gas, carbon dioxide or mixtures thereof. The driving fluid may also be water or brine and may contain additives such as a surfactant, to maintain effluent displacement of the driving fluid. Injection of the driving fluid is continued to effect displacement of the formation oil through the production well until either all of the oil has been displaced from the formation or until the economical limit of the ratio of the driving fluid to formation oil has been reached.

In another embodiment of the invention depending upon formation conditions such as temperature and pressure, it may be possible to lower the $CO_2$ MMP of the formation by the present cooling technique sufficiently so that the reduced $CO_2$ MMP is equal to or less than the existing formation pressure thereby eliminating the step of pressurizing the formation.

By the term "pore volume" as used herein, is meant that volume of the portion of the formation underlying the well pattern employed as described in greater detail in U.S. Pat. No. 3,927,716 to Burdyn et al, the disclosure of which is hereby incorporated by reference.

What is claimed is:

1. A method for the recovery of oil from a subterranean, oil-containing formation penetrated by at least one injection well and at least one spaced-apart production well and having fluid communication therebetween, comprising the steps of:

(a) determining the minimum miscibility pressure at the temperature of said formation at which carbon dioxide will misicibly displace said formation oil;

(b) injecting a sufficient amount of coolant, substantially immiscible on first contact with said oil, into the formation via said injection well to lower the temperature of the formation between the injection well and production well to a temperature correspondig to a predetermined lower $CO_2$ minimum miscibility pressure;

(c) injecting a fluid into said formation to pressurize said formation to a pressure at least equal to the predetermined lower $CO_2$ minimum miscibility pressure of step (b) at which miscibility exists between said carbon dioxide and said oil;

(d) injecting into said formation via said injection well a slug of carbon dioxide at said pressure of step (c) in an amount sufficient to establish a miscible transition zone of said slug with said formation oil;

(e) injecting a drive fluid into said formation via said injection well to drive the carbon dioxide and oil through the formation towards said production well; and (f) recovering oil displaced by the carbon dioxide from the formation via the production well.

2. The method of claim 1 wherein said driving fluid is selected from the group consisting of water, air, nitrogen, combustion gas, flue gas, separator gas, natural gas, carbon dioxide and mixtures thereof.

3. The method of claim 1 wherein the coolant is selected from the group consisting of water at a temperature lower than the formation temperature, water mixed with anti-freeze at a temperature below the normal freeze temperature of the pressurized water, Freon, liquid nitrogen, and liquid carbon dioxide.

4. The method of claim 1 wherein the amount of carbon dioxide injected during step (d) is within the range of 0.10 to 0.40 hydrocarbon pore volume.

5. A method for the recovery of oil from a subterranean, oil-containing formation penetrated by at least one injection well and at least one spaced-apart production well and having fluid communication therebetween, comprising the steps of:

(a) determining the minimum miscibility pressure at the temperature of said formation at which carbon dioxide will miscibly displace said formation oil;

(b) injecting a sufficient amount of coolant, substantially immiscible on first contact with said oil, into the formation via said injection well to lower the temperature of the formation between the injection well and production well to a temperature corresponding to a predetermined lower $CO_2$ minimum miscibility pressure, said predetermined lower $CO_2$ minimum miscibility pressure being equal to or less than the formation pressure;

(c) injecting into said formation via said injection well a slug of carbon dioxide at said pressure of step (b) in an amount sufficient to establish a miscible transition zone of said slug with said formation oil;

(d) injecting a drive fluid into said formation via said injection well to drive the carbon dioxide and oil through the formation towards said production well; and (e) recovering oil displaced by the carbon dioxide from the formation via the production well.

6. The method of claim 5 wherein the coolant is selected from the group consisting of water at a temperature lower than the formation temperature, water mixed with anti-freeze at a temperature below the normal freeze temperature of the pressurized water, Freon, liquid nitrogen, and liquid carbon dioxide.

7. The method of claim 5 wherein said driving fluid is selected from the group consisting of water, air, nitrogen, combustion gas, flue gas, separator gas, natural gas, carbon dioxide and mixtures thereof.

8. The method of claim 5 wherein the amount of carbon dioxide injected during step (d) is within the range of 0.10 to 0.40 hydrocarbon pore volume.

9. In a method for recovering oil from a subterranean, permeable viscous oil-containing formation traversed by at least one injection well and one production well by a process involving injecting a slug of carbon dioxide at a pressure at least at which the carbon dioxide is miscible with the formation oil and in an amount sufficient to form a miscible transition zone with the formation oil at the formation conditions of pressure and temperature, and thereafter injecting a driving agent to displace the formation oil and carbon dioxide toward the production well from which the oil is produced, the improvement comprising decreasing the $CO_2$ minimum miscibility of the formation by injecting a coolant fluid into the formation via said injection well prior to injecting said slug of carbon dioxide in an amount sufficient to lower the $CO_2$ minimum miscibility pressure of the formation a predetermined amount.

10. The method of claim 9 wherein the coolant is selected from the group consisting of water at a temperature lower than the formation temperature, water mixed with anti-freeze at a temperature below the normal freeze temperature of the pressurized water, Freon, liquid nitrogen, and liquid carbon dioxide.

* * * * *